US011174555B2

(12) United States Patent
Noffke et al.

(10) Patent No.: US 11,174,555 B2
(45) Date of Patent: Nov. 16, 2021

(54) CHROMIUM-FREE PLATING-ON-PLASTIC ETCH

(71) Applicant: MacDermid Enthone GmbH, Langenfeld (DE)

(72) Inventors: Frank Noffke, Wuppertal (DE); Christoph Werner, Sunnyvale, CA (US); Andreas Königshofen, Leverkusen (DE)

(73) Assignee: MacDermid Enthone GmbH, Langenfeld (DE)

( * ) Notice: Subject to any disclaimer, the term of this patent is extended or adjusted under 35 U.S.C. 154(b) by 118 days.

(21) Appl. No.: 16/461,110

(22) PCT Filed: Nov. 22, 2017

(86) PCT No.: PCT/EP2017/080122

§ 371 (c)(1),
(2) Date: May 15, 2019

(87) PCT Pub. No.: WO2018/095998

PCT Pub. Date: May 31, 2018

(65) Prior Publication Data

US 2020/0063264 A1 Feb. 27, 2020

(30) Foreign Application Priority Data

Nov. 22, 2016 (EP) ..... 16200092

(51) Int. Cl.

| | |
|---|---|
| ***C23C 18/20*** | (2006.01) |
| ***C23C 18/24*** | (2006.01) |
| ***C23C 18/30*** | (2006.01) |
| ***C23C 18/34*** | (2006.01) |

(52) U.S. Cl.
CPC ..... *C23C 18/2086* (2013.01); *C23C 18/24* (2013.01); *C23C 18/30* (2013.01); *C23C 18/34* (2013.01)

(58) Field of Classification Search
CPC ..... C23C 18/2086; C23C 18/24
See application file for complete search history.

(56) References Cited

U.S. PATENT DOCUMENTS

| | | | | |
|---|---|---|---|---|
| 5,160,600 | A * | 11/1992 | Patel | C23C 18/24 205/167 |
| 9,267,077 | B2 | 2/2016 | Weitershaus et al. | |
| 2014/0306147 | A1* | 10/2014 | Weitershaus | C09K 13/06 252/79.4 |
| 2015/0017331 | A1* | 1/2015 | Middeke | C25D 5/56 427/304 |
| 2016/0102403 | A1 | 4/2016 | Weitershaus et al. | |
| 2017/0159183 | A1* | 6/2017 | Nagamine | C25D 5/14 |

FOREIGN PATENT DOCUMENTS

| | | | |
|---|---|---|---|
| CN | 104995336 | | 10/2015 |
| EP | 2025708 | | 2/2009 |
| EP | 3009528 | | 4/2016 |
| EP | 2792702 | | 6/2017 |
| JP | 08319574 | | 12/1996 |
| JP | 2007100174 | | 4/2007 |
| JP | 2014212319 | | 11/2014 |
| JP | 2016104904 | | 6/2016 |
| KR | 10-2014-0124341 | | 10/2014 |
| KR | 10-2014-0138290 | | 12/2014 |
| WO | 2013/135863 | A1 | 9/2013 |
| WO | 2015060196 | | 4/2015 |
| WO | 2016006301 | | 1/2016 |
| WO | WO2016006301 | * | 1/2016 |
| WO | 2018216714 | | 11/2018 |

* cited by examiner

*Primary Examiner* — Nathan T Leong
(74) *Attorney, Agent, or Firm* — Carmody Torrance Sandak & Hennessey LLP

(57) ABSTRACT

The present invention relates to a chrome free etch for plating on plastic processes, wherein plastic surfaces are contacted in a first etching step with an etching solution at least comprising Mn(IV)-ions and, in a second etching step, with a solution at least comprising Mn(III)- and Mn(VII)-ions prior to the metal plating step.

11 Claims, No Drawings

CHROMIUM-FREE PLATING-ON-PLASTIC ETCH

The present invention relates to a chrome free etch for plating on plastic processes, wherein plastic surfaces are contacted in a first etching step with an etching solution at least comprising Mn(IV)-ions and, in a second etching step, with a solution at least comprising Mn(III)- and Mn(VII)-ions prior to the metal plating step.

The modification of surfaces by coherent deposition of other materials is a long established way of altering the physical and decorative properties of materials. Several processes have been established in order to address different substrates and different functional coating materials. Non-conductive substrates like plastic surfaces may for instance be modified by deposition of metal-layers in order to either change the electrical properties of or to impart a more valuable finish to the plastic workpieces. Such metallization processes, i.e. plating on plastics (pop) processes, are widely used for manufacturing integrated circuits, printed circuit boards or other electronic components and additionally in the field of automotive and sanitation parts. In both application areas the adhesion strength of the additional applied layer on the plastic surface is a fundamental quality parameter. It is obvious, that the overall functional and decorative lifetime directly scales to the adhesion properties of the different layers. Therefore, in order to increase the achievable adhesion strength it is a common process step to roughen the relevant surfaces of a plastic substrate prior to metal deposition. This process step is commonly known as etching or pickling and usually sulfuric acid/chromium is employed to achieve plastic surface roughening. In this step certain plastic surface parts, e.g. butadiene moieties in ABS or ABS-blend plastic material, are oxidatively decomposed, consequently forming caverns or dips in the plastic surface. These caverns or dips are able to function as fixtures to subsequent deposited metal coatings and lead to higher/better adhesion of the additional deposited layer.

For example, WO2005094394 discloses a process for preparing a non-conductive substrate for subsequent metallization. In this document a plastic surface is etched with an etching solution comprising a permanganate and a mineral acid.

U.S. Pat. No. 7,025,867 discloses the treatment of a plastic surface with an acidic permanganate solution prior to direct electrolytic metallization of an electrically non-conductive substrate surface.

German patent DE 197 40 431 C1 discloses an etching step in the metallization of an electrically non-conductive surface area in which the substrate surface is treated with an acidic etching solution containing a hydrogen peroxide. The acid in the acidic solution may be phosphoric acid.

WO2009/023628 discloses an etching solution for the surface pre-treatment of a plastic surface in preparation of a subsequent metallization, the solution comprises a source of Mn(VIII) ions and an inorganic acid, wherein the pickling solution is substantially free of chromium(VI)-, alkali-, and alkaline-earth ions.

Nevertheless, albeit the existence of numerous etching processes in the literature and in industry there is still the need for further environmentally friendly high quality processes, which are able to deliver reproducibly optically superior metal plated plastic parts comprising high adhesion strength between the plastic surface and the deposited metal layer and hence superior application properties.

Therefore, it is the intention of the invention at hand to solve the above mentioned task and to especially disclose a modified etching process and etching process solutions, which are able to deliver high quality plating results including increased adhesion of the deposited metal-layers on plastic workpieces.

The above mentioned task is inventively solved by a process for metallization of plastic surfaces at least comprising the steps of a) Cleaning,
b) Etching,
c) Rinsing,
d) Activation and
e) Metallization, wherein etching step b) is a two-stage process, wherein in a first etching step b1) the plastic surfaces are contacted with a first etching solution at least comprising Mn(IV)-ions and, in a second etching step b2), the plastic surfaces are contacted with an etching solution at least comprising Mn(III)- and Mn(VII)-ions. It was surprisingly found that the deposition of metals on plastic surfaces do show superior results in these cases, where the etching step is separated into two distinct etching steps, wherein in each step manganese cations of a different oxidation state are present. Such partitioned etching steps deliver plated plastics parts comprising a very homogeneous plated surface, better metal cover and the adhesion of the plated metal layer is better compared to etching processes, wherein just one oxidation state of the cationic manganese specie is present. A very wide working window is achieved by this process and very good results are additionally obtainable in those cases where no in-between rinsing is performed between the different etching steps. A comparison between state-of-the-art etching and a process according to the invention is summarized in the following table:

| Process step | standard POP-process | inventive POP |
|---|---|---|
| I | Acid or neutral cleaner, rinse | |
| II | Etch ($H_2SO_4$, Cr) | a) $Mn^{4+}$<br>b) $Mn^{7+/3+}$ |
| III | Rinse (4x) | |
| IV | HCl dipping | |
| V | Activation (Pd) | |
| VI | Rinse (2x) | |
| VII | Accelerator | |
| VIII | Rinse (2x) | |
| IX | Electroless nickel | |

As it can be depicted from the table it is possible to achieve a chrome-free etching process, which is environmentally friendly compared to state-of-the-art processes using chromium-ions for the etching step. Without being bound by a special theory it is believed that by splitting the etching step, different targets on the plastic surface are modified, leading to a more homogeneous roughening/preparation of the plastic surface prior metal plating. It is believed that in the first etching step colloidal Mn(IV) particles are present in solution which are able to specifically interact with certain parts of the polymer surface. In the case of ABS—(Acrylonitrile butadiene styrene)—surfaces the particles only attack the butadiene phase of ABS and not the acrylonitrile frame. The acrylonitrile frame is only attacked in the second etching step, wherein besides the acrylonitrile frame additionally the already etched butadiene phase is further oxidized. Such treatment results in the formation of a different size distribution and location of etch holes in the plastic surfaces serving later on in the process as deposition caverns for e.g. palladium/tin colloidal particles. In a further step the tin can be removed, so that the active palladium remains. In the case of nickel deposition the catalytic potential of the palladium and the electroless nickel electrolyte, which contains a reducing agent, initiate in a subsequent step the deposition of nickel on the palladium sites. On this metal (flash) layer other metals like copper, electric nickel etc. can be plated.

A further advantage of the inventive etching process is, that there is no need to use additionally organic based sweller in order to achieve good plating results. Therefore, it is possible to avoid some of the disadvantages included in the use of organic swellers, i.e.

- the organic sweller may be forbidden in the future based on environmental considerations (e.g. COD-values of the waste water);
- the deposition line can be shorter, because sweller baths can be omitted;
- the working window of the organic sweller is rather short (2-3 minutes) and longer exposure times may result in a reduced macro-stability of the plastic surface;
- the organic sweller may remain in the substrate surface and may weaken the plastic surfacing structure inducing crack and break formation under load.

However, although an organic sweller can be omitted in the inventive etching steps it is also possible to include such class of molecules within the disclosed two-step etching-system.

The process is applicable for the metallization of a variety of non-conductive polymer (plastic) substrates including, for example, acrylonitrile butadiene styrene (ABS), acrylonitrile butadiene styrene/polycarbonate (ABS/PC), polyamide (PA), polypropylene (PP), thermoplastic olefins (TPO's), polyphenyleneoxide (PPO), polyphenylene ether, polyimides, polyether imide (PEI), polyether ether ketone (PEEK), polyphenylene sulfide, polyphthalamide, polyurethane (PU) and its blends as well as composites such as epoxy-glass laminates. Other suitable non-conducting substrates such as ceramic materials may also be suitably selected by those of skill in the art. All of these materials offer surface structures of different oxidizability.

The inventive etching step is compatible with a wide range of further processing steps known to the skilled artisan in order to perform a metallization of plastic process. Therefore, the other mentioned process steps, i.e. a) cleaning, c) rinsing, d) activation and e) metallization, can be performed in different ways using different bath composition and active species.

Operable compositions for the single steps are known to the skilled artisan. In addition, it is possible to include further processing step not explicitly mentioned in the above given list.

For the etching according to the invention it is necessary to contact the plastic surfaces in first etching step b1) with a first etching solution at least comprising Mn(IV)-ions. This step can for instance be performed by dipping the plastic parts into a solution comprising Mn(IV)-ions or spraying such solution onto the surface of the plastic parts. The contact time of the solution and the plastic parts may be adjusted according to the geometry of the parts or the material itself. Suitable contact times may vary between several seconds, for instance 30 seconds, up to several minutes, e.g. 30 minutes. Good results have for instance been achieved by contact times between 5 and 15 minutes. In addition, the first etching solution comprise Mn(IV)-ions. This means, that the solution may also contain other metal-cations besides manganese, manganese cations in other oxidation states and/or other substances like, for instance, wetting agents.

In the second etching step b2), the plastic surfaces are contacted with a an etching solution at least comprising Mn(III)- and Mn(VII)-ions. This means that in the second etching step the plastic surfaces are in contact with another solution at least comprising Mn(III)- and Mn(VII)-ions. It is within the scope of the invention that between the first and the second etching step the solution is changed. In between both steps an additional rinsing can be performed or the second solution may be introduced without a rinsing step. Anyhow, a rinse between the first and the second etching is preferred. The contact times in the second step can be similar to the contact times of the first step. The second etching solution may also contain additional organic substances and/or metal-species.

Within a preferred aspect of the process the concentration of the Mn(IV)-ions in the first etching step b1) can be ≥0.5 g/l and ≤15 g/l and the concentration of the Mn(III)- and Mn(VII)-ions in the second etching step b2) can be ≥0.05 g/l and ≤20 g/l. In order to assure an effective etching within suitable processing times it has been found useful to contact the plastic surfaces to solutions comprising the above mentioned concentrations of the cationic manganese species. Within these concentration ranges even difficult to coat plastic surfaces, for instance comprising sharp edges or larger surface structures, can be etched in a way, that the resulting metal coating is very homogeneous and shows a very good adherence to the plastic surface. If processing time is a crucial parameter the Mn(IV)-ion concentration may further be adjusted in between ≥2.0 g/l and ≤10 g/l, preferably in between ≥3.0 g/l and ≤8 g/l and the Mn(III)- and Mn(VII)-ion concentration may further be adjusted in between ≥0.1 g/l and ≤10 g/l, preferably in between ≥0.5 g/l and ≤5 g/l. In these concentration ranges even hard to etch plastic surfaces can be reliably etched and a good adherence and homogeneous metal surfaces are obtained.

In a further embodiment of the process the bath temperature in the first etching step b1) can be ≥20° C. and ≤60° C. and bath temperature in the second etching step b2) can be ≥30° C. and ≤80° C. The etching kinetics can also be influenced by the bath temperatures in the single steps. Good results and decent processing times were achieved in above mentioned temperature ranges. It is especially preferred that the second etching step is performed at higher bath temperatures. Qualitatively very good coatings are obtained at bath temperatures of ≥30° C. and ≤50° C., preferably ≥35° C. and ≤45° C. for the first etching step and ≥40° C. and ≤75° C., preferably ≥60° C. and ≤73° C. for the second etching step. Overall process times can be shortened in that temperature range and the baths, especially the oxidation states of the manganese ions, are still chemically stable.

Within an additional embodiment of the process the pH of both etchings solutions in the etching steps b1) and b2) can be ≤1.0. Preferably, the etching solutions of both etching steps are very acidic. The acidity of the solution might influence the swelling behavior of the plastic surfaces and additionally, may influence the oxidative power of the metal-cations. Thus, the degradation of the polymeric surface can be altered by changing pH. An acidity below 1.0 has been found useful to assure reproducible etching outcomes and very economic processing times. In addition, the pH might be adjusted to ≤0.5 and even more preferred to ≤0.1.

In another characteristic of the process the etching solutions in step b1) and b2) each may at least comprise an acid selected from the group consisting of phosphoric acid, sulfuric acid, methanesulfonic acid or combinations thereof. This group of acids may be used in order to adjust the preferred pH-range. Without being bound by the theory these acids do not only supply the necessary hydronium-ions to the solution. This group of acids also interferes with the swelling of the plastic surface, resulting in a defined and preferred oxidation of the plastic surface, which in turn results in the formation of a metal layer comprising a very good adhesion to the plastic parts.

Furthermore, in another aspect of the process the bath of etching step b1) may further comprise a metal-ion selected from the group consisting of Ag, Bi, Pd, Co or mixtures thereof. The quality of the metallized surface can even be improved by the presence of at least one of the above mentioned metals. Without being bound by the theory it is believed that these further metal ions either are able to alter the strength of oxidation step in the etching step or are already deposited on the surface of the plastic part and may change the deposition behavior of the activator. Nevertheless, based on the presence of such further ions it is possible to achieve very homogeneous coatings even on difficult to coat plastic surfaces. Such coatings do also comprise exceptionally high tear strength compared to standard coatings with standard etch-procedures.

Within a preferred embodiment of the process the concentration of the further metal-ion in the bath of etching step b1) can be ≥50 mg/l and ≤1000 mg/l. Within the given time constraints in processing it was found that the above given concentration range is able to further increase the adhesion of metal layers on plastic parts. The range can preferably also be chosen in between ≥100 mg/l and ≤800 mg/l and even more preferred in between ≥250 mg/l and ≤600 mg/l. Within that range a better stability of the Mn(IV)-ion is given and the tendency of disproportionation is decreased.

In an additional aspect of the inventive process the density of the etching baths in etching step b1) and b2) is ≥1.5 g/cm$^3$ and ≤1.8 g/cm$^3$. It has been found suitable to keep/adjust the density of both etching solutions in above mentioned density range. Within this density range an efficient wetting behavior of the etch-solution on the plastic parts is obtained, which render the presence of further wetting agents in the etch-solutions unnecessary. Thus, it is possible to achieve also good coating results on hard to coat plastic surfaces without increase of the etch-solution-COD (chemical oxygen demand).

In addition, in a further embodiment the Mn(IV)-ion concentration in etching step b1) and the Mn(III)- and Mn(VII)-ion concentration in etching step b2) can be adjusted electrochemically by oxidation of solutions at least comprising one or more Mn(II)-salts. Within this embodiment the active manganese oxidation state is not achieved by dissolution of a suitable manganese salt comprising the metal in the desired oxidation state. In this embodiment the active oxidation state is electrochemically generated in situ. The defined oxidation states are generated by the application of a current to the solution. The skilled artisan is aware how to choose suitable currents in order to achieve the necessary concentration of the "right" oxidation state. The concentrations of the manganese ions in the different oxidations-states can be accessed analytically, as for instance outlined in the experimental part. Suitable manganese(II) salts are for instance $MnCO_3$, $MnSO_4$, MnO, $MnCl_2$, $Mn(CH_3COO)_2$ and $Mn(NO_3)_2$ or mixtures thereof. But it is also possible to start with manganese +III salts like for instance $Mn_2O_3$, $MnPO_4$, MnO(OH), $Mn(CH_3COO)_3$ and $MnF_3$ or mixtures thereof. Also possible is the use of Mn(IV) salts like for instance $MnO_2$. Such electrochemical adjustment of the oxidation states and concentrations eases the process logistic.

In another preferred embodiment of the process the overall Mn-concentration of the bath in etching step b1) can be ≥3.0 g/l and ≤20.0 g/l and in etching step b2) can be ≥0.1 g/l and ≤25.0 g/l. Besides the concentration range of the manganese in the specific oxidation states also the overall manganese concentration in the single etching-bath can influence the process outcome. In order to generate a stable bath and avoid the possibility of a too aggressive etching the above mentioned concentration range has been found useful.

Within a further aspect of the process the Mn(II)-salt in the baths of etching step b1) and b2) can be selected from the group consisting of Mn(II)sulfate, Mn(II)methanesulfonate, Mn(II)methanedisulfonate or mixtures thereof. Especially the manganese salts comprising additional sulfur in the salt anions do exhibit very good coating results including very homogeneous surface coating and excellent coating adhesion. It cannot be excluded that also the anion is somehow interfering with the oxidation of the plastic surface and contributes to the good coating results.

A kit of parts is further within the scope of this invention at least comprising two etching solutions suitable for the surface pre-treatment in electrochemical plating on plastic processes, wherein the kit comprises at least a first and a second etching solution, wherein the first etching solution at least comprises: a Mn-concentration of ≥3.0 g/l and ≤20.0 g/l, a Mn(IV)-concentration of ≥0.5 g/l and ≤8.0 g/l, a pH of ≤1.0, a metal-ion selected from the group consisting of Ag, Bi, Pd, Co in a concentration of ≥50 mg/l and ≤1000 mg/l; and the second etching solution at least comprises a Mn-concentration of ≥1.0 g/l and ≤25.0 g/l, a Mn(III) and Mn(VII)-concentration of ≥0.05 g/l and ≤25.0 g/l, a pH of ≤1.0. The etching solutions of above mentioned kit can be designed as ready-to-use-solutions, wherein the plastic parts just has to be dipped in or sprayed with, or the solutions can be concentrates and supplemented for instance with additional water directly before use. The latter embodiment might easy the logistics and the transportation costs.

Within a further preferred embodiment the kit of parts comprises at least two etching solutions, wherein the first and the second etching solution comprise a pH≤0.5 and the pH is adjusted at least in part by the presence of methanesulfonic, phosphoric and sulfuric acid or mixtures thereof.

Within a preferred embodiment the kit of parts may comprise etching solutions, wherein the first etching solution additionally comprises a stabilizer selected from the group consisting of N'-(2-aminoethyl)ethane-1,2-diamine, dimethyl-bis(oxiran-2-ylmethyl)azanium, hexanedioic acid, chloride or mixtures thereof. This stabilizer may ensure a better and more uniform metal seizure after etching and may be able to reduce course trails in the electrical metallization step.

In another aspect the kit of parts may comprise two etching solutions, wherein the density of the first and the second etching solution is ≥1.5 g/cm$^3$ and ≤1.8 g/cm$^3$.

With respect to inventive features and properties of the kit of parts it is especially referred to the properties and features of the inventive process and vice versa. Therefore, all disclosed features for the inventive process shall also be deemed disclosed for the claimed kit of parts and vice versa. Also a combination of at least two preferred embodiments is deemed to be within the scope of invention unless otherwise disclosed in the description.

EXAMPLES

0. Analytical Methods 0.1 Analytical determination of Mn total

The overall Mn-concentration was accessed by titration with 0.1 m zinc sulfate-solution.

0.2 Analytical determination of Mn IV+

The Mn IV+ concentration was determined by titration with 0.1 m Fe(III)sulfate-solution or by UV/VIS-calibration curves.

0.3 Analytical determination of Mn VII+/III+

The Mn IV+ concentration was determined by titration with 0.1 m Fe(III)sulfate-solution or by UV/VIS-calibration curves.

0.4 Analytical determination: Peeling Test

The peeling test was performed according to DIN 40802.

0.5 Analytical determination: pull-off-test

The pull-off-test was performed according to DIN EN 4624.

I. Example 1 (Etch According to the Invention)

Prior to the plating on plastic a 2-step etching process is performed, wherein the plastic surfaces are contacted with two different etch solutions. No rinsing step is performed in-between both etching steps.

I.1 Preparation of the First Etching-Solution (for Step b1))

The first etching-solution is prepared using the following composition

| | |
|---|---|
| Demineralized water | 45 ml/l |
| Mn(II)-sulfate solution 10% | 120 ml/l |
| Methansulfonic acid (MSA) 70% | 300 ml/l |
| $H_3PO_4$ 85% | 60 ml/l |
| $H_2SO_4$ conc. | 550 ml/l |
| Catalyst (Ag-MSA: 275 g/l Ag) | 2 ml/l |
| Stabilizer N'-(2-aminoethyl)ethane-1,2-diamine, dimethyl-bis(oxiran-2-ylmethyl)azanium; hexanedioic acid | 0.5 ml/l |
| The first etching solution can be characterized by | |
| Density | 1.659 g/ml |
| pH | <0 |

Before the first etching solution can be used at least a part of the $Mn^{2+}$ (0.5-6 g/l) is oxidized to an oxidation state of +IV. This oxidation was performed for 10 h at 2 A/dm$^2$/l (43° C., cathode stainless steel, anode platinized titanium). It is also possible to use platinized Niob or MOX-anodes. Upon oxidation the solution changed the color from light pink to brownish. In order to maintain the necessary Mn +IV concentration in the bath for repeated etch-treatments a steady state current of 0.5 A/l etch solution may be applied.

The immersion time for the plastic parts in the etching solution 1 was set to 5 minutes.

I.2 Preparation of the Second Etching-Solution (for Step b2))

| | |
|---|---|
| Demineralized water | 25 ml/l |
| Mn(II)-sulfate solution 10% | 60 ml/l |
| MSA 70% | 335 ml/l |
| $H_3PO_4$ 85% | 55 ml/l |
| $H_2SO_4$ conc. | 470 ml/l |
| The second etching solution can be characterized by | |
| Density | 1.66 g/ml |
| pH | <0 |

Before the second etching solution can be used at least a part of the $Mn^{2+}$ (approx. 1 g/l) is oxidized to an oxidation state of +VII/+III. This oxidation was performed for 6 h at 20 A/dm$^2$/l (70° C., cathode stainless steel, anode platinized titanium). Upon oxidation the solution changed the color from light pink to purple. In order to maintain the necessary Mn +VII/+III concentration in the bath for repeated etch-treatments a current of 0.5 A/l etch solution may for instance be applied once a week for two hours.

The immersion time for the plastic parts in the etching solution 1 was set to 5 minutes.

I.3 Plating of Parts Etched According to the Invention:

5 difficult to etch ABS parts were first etched by contacting the parts with etching solution 1 and, without rinsing, with etching solution 2 (as defined above).

The inventively etched plastic parts were plated electrolytically according to the following standard process sequence:

Activation:

quadruple rinse/reducer/double rinse/pre-dip/activator/double rinse

Plating:

accelerator/double rinse/electroless nickel/double rinse/copper dip/rinse/pre-plate copper strike/rinse/bright copper/double rinse/semi-bright nickel/double rinse/bright nickel/double rinse/microporous nickel/double rinse/chromium/double rinse/drying The resulting deposit was uniform and covered fully the plastic parts without any defects. The adhesion of the deposited layer was determined by a pull-off test and revealed values of at least 10 N/mm$^2$.

Compared to a standard single step etching process the REM-surface pictures of the inventively plated plastic parts revealed a more uniform plating result. It appears that more butadiene wholes were etched and the etched wholes seem to be homogeneously spread and deeper. In consequence, a better adhesion of the metallic layer is obtained.

Peeling tests were performed on the inventively etched plated plastic parts. The test was performed by 3 independent persons. A defined surface was peeled with a tool and the force which was needed to separate the copper-layer from the plastic was assessed. The result was rated okay if a considerable force has to be applied in order to separate the layers. The adhesion of the double etched parts was considered ok, whereas most of the single etched parts failed (easy delamination). The deposited layers on the double etched plastic were generally free of delaminations and exhibited a good adhesive strength of the metallic layer.

II. Example 2 (According to the Invention)

II.1 Preparation of the First Etching-Solution (for Step b1))

The first etching-solution is prepared using the following composition

| | |
|---|---|
| Demineralized water | 125 ml/l |
| Mn(II)-sulfate solution 10% | 120 ml/l |
| MSA 70% | 200 ml/l |
| $H_3PO_4$ 85% | 60 ml/l |
| $H_2SO_4$ conc. | 600 ml/l |
| Catalyst (Ag-MSA: 275 g/l Ag) | 4 ml/l |
| Stabilizer N'-(2-aminoethyl)ethane-1,2-diamine, dimethyl-bis(oxiran-2-ylmethyl)azanium; hexanedioic acid | 0.5 ml/l |
| The first etching solution can be characterized by | |
| Density | 1.658 g/ml |
| pH | <0 |

Before the first etching solution can be used at least a part of the $Mn^{2+}$ (0.5-6 g/l) is oxidized to an oxidation state of +IV. This oxidation was performed for 10 h at 2 A/dm$^2$/l (43° C., cathode stainless steel, anode platinized titanium). Upon oxidation the solution changed the color from light pink to brownish. In order to maintain the necessary Mn +IV concentration in the bath for repeated etch-treatments a steady state current of 0.5 A/l etch solution may be applied.

II.2 Preparation of the Second Etching-Solution (for Step b2))

| | |
|---|---|
| Demineralized water | 135 ml/l |
| Mn(II)-sulfate solution 10% | 120 ml/l |
| MSA 70% | 230 ml/l |
| $H_3PO_4$ 85% | 30 ml/l |
| $H_2SO_4$ conc. | 645 ml/l |
| Strong nonionic Fluorosurfactant | 0.4 ml/l |
| Triethanolamine | 2 ml/l |
| The second etching solution can be characterized by | |
| Density | 1,675 g/ml |
| pH | <0 |

Before the second etching solution can be used at least a part of the $Mn^{2+}$ (approx. 1 g/l) is oxidized to an oxidation state of +VII/+III. This oxidation was performed for 6 h at 0.025 A/dm$^2$/l (70° C., cathode stainless steel, anode platinized titanium). Upon oxidation the solution changed the color from light pink to purple. In order to maintain the necessary Mn +VII/+III concentration in the bath for repeated etch-treatments a current of 0.5 A/l etch solution may for instance be applied once a week for two hours.

II.3 Plating of Parts Etched According to the Invention:

5 difficult to etch ABS parts were first etched by contacting the parts with etching solution 1 and, without rinsing, with etching solution 2 (as defined above).

The inventively etched plastic parts were plated electrolytically according to the following standard process sequence:

Activation:

quadruple rinse/reducer/double rinse/pre-dip/activator/double rinse

Plating:

accelerator/double rinse/electroless nickel/double rinse/copper dip/rinse/pre-plate copper strike/rinse/bright copper/double rinse/semi-bright nickel/double rinse/bright nickel/double rinse/microporous nickel/double rinse/chromium/double rinse/drying The deposited layers are free of delaminations and exhibit a good adhesive strength.

III. Comparative Example—Standard $Mn^{3+/7+}$ Etch

A standard plating-on-plastic was performed on two difficult to etch plastic parts using a single-step etching process. The etching step was performed using the following bath composition:

| | |
|---|---|
| DI water | 180 ml/l |
| Mn(II)-sulfate solution 10% | 60 ml/l |
| MSA 70% | 230 ml/l |
| $H_3PO_4$ 85% | 30 ml/l |
| $H_2SO_4$ conc. | 645 ml/l |

The density of the etching bath was 1.65 g/cm$^3$ and the etching time was set to 10 minutes. The plating procedure was the same as given above.

The metal plating on the plastic part is very inhomogeneous and the layer is easily peeled of the plastic surface.

The invention claimed is:

1. Process for metallization of plastic surfaces at least comprising the steps of a) Cleaning, b) Etching, c) Rinsing, d) Activation and e) Metallization, characterized in that etching step b) is a two-stage process, wherein in a first etching step b1) the plastic surfaces are contacted with a first etching solution at least comprising Mn(IV)-ions and, in a second etching step b2), the plastic surfaces are contacted with an etching solution at least comprising Mn(III)- and Mn(VII)-ions;

wherein the concentration of the Mn(IV)-ions in the first etching step b1) is ≥0.5 g/l and ≤15 g/l and the concentration of the Mn(III)- and Mn(VII)-ions in the second etching step b2) is ≥0.05 g/l and ≤20 g/l; and wherein the Mn(IV)-ion concentration in etching step b1) and the Mn(III)- and Mn(VII)-ion concentration in etching step b2) is adjusted electrochemically by oxidation of solutions at least comprising one or more Mn(II)-salts.

2. Process according to claim 1, wherein the bath temperature in the first etching step b1) is ≥20° C. and ≤60° C. and bath temperature in the second etching step b2) is ≥30° C. and ≤80° C.

3. Process according to claim 1, wherein the pH of both etchings solutions in the etching steps b1) and b2) is ≤1.0.

4. Process according to claim 1, wherein the etching solutions in step b1) and b2) each at least comprise an acid selected from the group consisting of phosphoric acid, sulfuric acid, methanesulfonic acid or combinations thereof.

5. Process according to claim 1, wherein the bath of etching step b1) further comprises a metal-ion selected from the group consisting of Ag, Bi, Pd, Co or mixtures thereof.

6. Process according to claim 5, wherein the concentration of the further metal-ion in the bath of etching step b1) is ≥50 mg/l and ≤1000 mg/i.

7. Process according to claim 1, wherein the density of the etching baths in etching step b1) and b2) is ≥1.5 g/cm$^3$ and ≤1.8 g/cm$^3$.

8. Process according to claim 1, wherein the overall Mn-concentration of the bath in etching step b1) is ≥3.0 g/l and ≤20.0 g/l and in etching step b2) is ≥0.1 g/l and ≤25.0 g/l.

9. Process according to claim 1, wherein the Mn(II)-salt in the baths of etching step b1) and b2) is selected from the group consisting of Mn(II)sulfate, Mn(II)methanesulfonate, Mn(II)methanedisulfonate or mixtures thereof.

10. The process according to claim 1, wherein the first etching solution additionally comprises a stabilizer selected from the group consisting of N'-(2-aminoethyl)ethane-1,2-diamine, dimethyl-bis(oxiran-2-ylmethyl)azanium, hexanedioic acid, chloride or mixtures thereof.

11. The process according to claim 1, wherein the steps are performed in order.

* * * * *